United States Patent [19]

Bennett

[11] 4,200,286

[45] Apr. 29, 1980

[54] SET OF TORQUE-BALANCED GOLF CLUBS

[76] Inventor: Richard C. Bennett, 7333 Armitage Ave., Elmwood Park, Ill. 60635

[21] Appl. No.: 859,031

[22] Filed: Dec. 9, 1977

[51] Int. Cl.[2] ..... A63B 53/04

[52] U.S. Cl. ..... 273/77 A; 273/167 F

[58] Field of Search ..... 273/77 R, 77 A, 80 A, 273/167 R, 167 F; 73/65

[56] References Cited

U.S. PATENT DOCUMENTS

| | | | |
|---|---|---|---|
| D. 125,455 | 2/1941 | Newsome | 273/169 X |
| D. 179,092 | 10/1956 | Pavlis | 273/169 X |
| 1,516,786 | 11/1924 | Prentiss | 273/77 A |
| 1,525,148 | 2/1925 | Pickop | 273/169 X |
| 1,642,462 | 9/1927 | Reach | 273/77 A |
| 1,825,172 | 9/1931 | Barret | 273/77 A X |
| 1,917,774 | 7/1933 | Ogg et al. | 273/77 A |
| 2,846,228 | 8/1958 | Reach | 273/167 F X |
| 3,059,926 | 10/1962 | Johnstone | 273/77 A |
| 3,371,523 | 3/1968 | Crouch et al. | 273/77 A X |
| 3,473,370 | 10/1969 | Marciniak | 273/77 A |
| 3,595,577 | 7/1971 | Hodge | 273/167 F X |
| 3,655,188 | 4/1972 | Solheim | 273/77 A |
| 3,722,887 | 3/1973 | Cochran et al. | 273/77 A |
| 3,751,035 | 8/1973 | Lockwood | 273/77 A |
| 3,858,886 | 1/1975 | Cosby | 273/167 F |
| 3,871,649 | 3/1975 | Kilshaw | 273/77 A |
| 3,984,103 | 10/1976 | Nix | 273/77 A |
| 4,128,242 | 12/1978 | Elkins | 273/77 A |

FOREIGN PATENT DOCUMENTS

| | | | |
|---|---|---|---|
| 1220804 | 1/1971 | United Kingdom | 273/77 A |

OTHER PUBLICATIONS

"Golf World"; Jun. 24, 1977; p. 10.

*Primary Examiner*—Richard J. Apley

*Attorney, Agent, or Firm*—Vogel, Dithmar, Stotland, Stratman & Levy

[57] ABSTRACT

The torque of each club about its shaft measured with the club oriented at the angle at which it is used to address the ball is substantially the same as the corresponding torque of every other club in the set.

2 Claims, 11 Drawing Figures

SET OF TORQUE-BALANCED GOLF CLUBS

BACKGROUND OF THE INVENTION AND PRIOR ART STATEMENT

A set of golf clubs usually includes three or four "woods", eight or so "irons", a putter, and perhaps some specialty clubs such as pitching and sand wedges. One of the woods, termed the driver, is used to drive the ball from the tee, while the other woods and the irons are used to hit balls on the fairway. Of course, there are instances when one would use one of the other woods or one of the irons to drive the ball from the tee.

Each club has a shaft and a head at one end. The lengths of the clubs vary as do the inclinations of the striking surfaces of the heads. The clubs which are used to drive the ball great distances have long shafts and steep striking surfaces.

Golf clubs, and in particular clubs with which this invention is primarily concerned, namely the irons, are usually manufactured in a set and bear numbers from 2 to 9. Such sets may also include a number 1 iron and other specialty irons such as the pitching and sand wedges. The loft on the face of the irons increases from the number 2 iron progressively through to the number 9 iron. Also, the length of the club decreases from the number 2 iron progressively to the number 9 iron. The combination of inclination of the surface that strikes the ball and the length of the clubs, causes the ball to travel progressively farther from the number 9 iron to the number 2 iron, while the loft or vertical height of the ball increases progressively from the number 2 iron to the number 9 iron.

It is known that the effective weight of each iron should be the same, effective in the sense that each iron feels as if it has the same weight. This is accomplished by maintaining the moment for each iron constant; that is to say, the length of the shaft times the weight of the head is the same for all irons. Also, the weight of the shaft itself is taken into consideration. Actually, it has been determined empirically that the point to measure this moment is not at the free end of the iron, but rather at a point 12 to 14 inches from the free end. All of the irons in a set are swing weighted so that when balanced at a selected point, say 12 inches from the end, the same weight can be applied to the free end of the club to balance it. The woods may be swing weighted also.

There have been efforts made from time to time to reduce the differences in feel and performance of the clubs. For example, U.S. Pat. No. 1,917,774 which issued to Ogg et al. advances the concept of maintaining constant the location of the "sweet spot". The weight of each head is redistributed such that the moments about a line passing through the center of the hitting surface of the head and the club handle are constant. Similarly, U.S. Pat. No. 1,642,462 to Reach advocates maintaining constant the location of the sweet spot.

In U.S. Pat. No. 3,059,926 to Johnstone the weight is distributed so that the optimum point of contact on the head is near the shaft for the 9 iron and is farthest from the shaft for the 1 iron, for the stated purpose of automatically imparting desired rotation to the golf ball.

There have been suggestions in the art of redistributing the weight in the head to achieve some specified object, such as U.S. Pat. No. 2,846,228 to Reach and others of the patents mentioned above.

The art has failed to take into consideration the change in feel between the clubs occasioned by the rotation of the club about its axis during the swing. Because of the golfer's anatomy, the club inherently rotates about the axis of the shaft as it is being swung. U.S. Pat. No. 3,595,577 to Hodge recognizes the existence of this twisting of the club during the swing.

It has not been heretofore recognized that each iron in a so-called matched set has a different twisting or moment about the shaft axis as it is being swung. Thus, although currently available irons are balanced in one sense to maintain the "feel" constant, the different twisting effect of each iron causes a different quantity of spin to be imparted to the ball, whereby one iron will cause the ball to hook (or slice) to one extent and another club to cause it to hook (or slice) to a different extent, making control that much more difficult. At best, a highly skilled golfer will subconsciously adjust his swing to compensate for the differences in moment about the shaft axis.

SUMMARY OF THE INVENTION

It is therefore an important object of the present invention to provide a set of matched golf clubs, the moment about each club axis when at its normal address angle, being substantially constant.

Another object of the present invention is to provide a set of matched clubs in which the inherent twisting movement of all the clubs is constant.

In summary, there is provided a set of torque-balanced golf clubs, each comprising a shaft and a head at one end thereof, the head of each club being adapted to rest on the ground such that a predetermined angle is formed between the associated shaft and the ground, the torque of each club about its shaft measured with the club oriented at its associated predetermined angle being substantially the same as the corresponding torque of every other club in this set of clubs.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the invention.

BRIEF DESCRIPTION OF THE DRAWINGS

For the purpose of facilitating an understanding of the invention, there is illustrated in the accompanying drawings, preferred embodiments thereof, from an inspection of which, when considered in connection with the following description, the invention, its construction, and operation, and many of its advantages should be readily understood and appreciated.

DETAILED DESCRIPTION OF THE PREFERRED EMBODIMENTS

Figure 2:
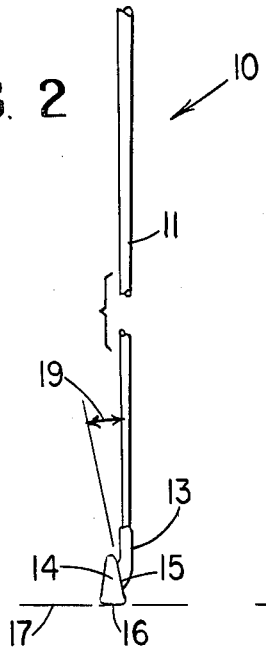
FIG. 2 is a front view of the head of the iron and ball.
Figure 1:
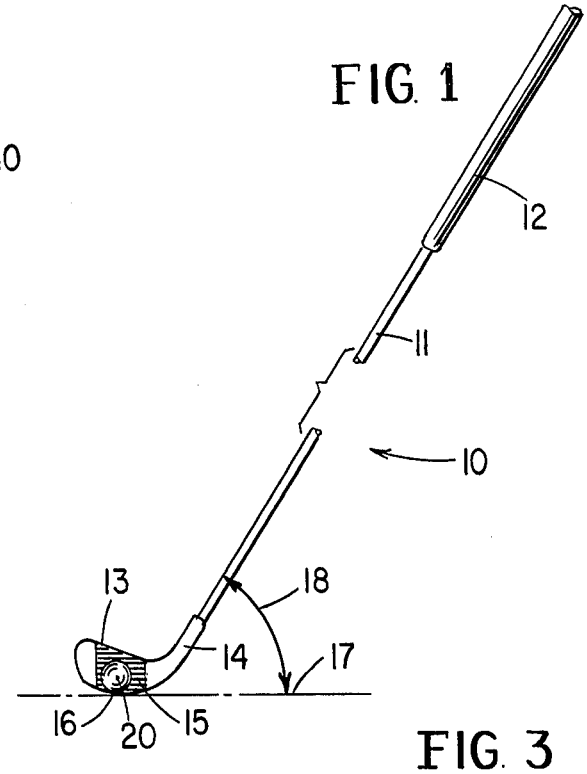
FIG. 1 is an elevational view of a golfing iron in a ball-addressing position.

Turning now to the drawings, there is illustrated in FIGS. 1 and 2 a number 2 iron 10 having a shaft 11. A grip 12 is formed at one end of the shaft 11, and a head 13 is permanently secured to its other end. The head 13 has a hosel 14 within which the shaft 11 is inserted and permanently attached. The head 13 has a hitting surface 15 and a sole 16 which rests on the ground 17. The angle 18 between the axis of the shaft 11 and the ground 17 is predetermined, and depends upon the number of the iron. For example, the iron 10 is a number 2 iron, in which case the predetermined angle 18 is 57°. The angles for the other irons are set forth below.

Figure 3:
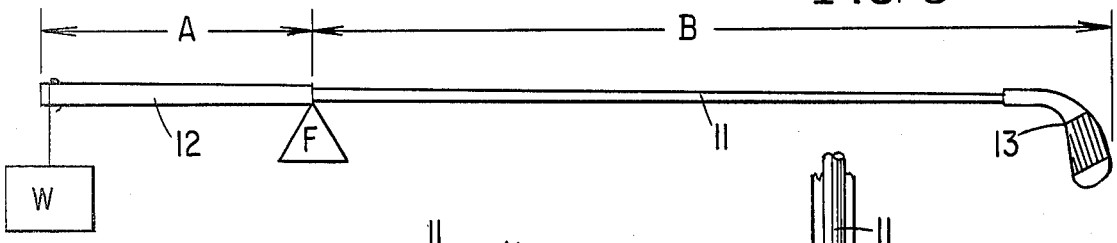
FIG. 3 is a schematic representation of the manner by which the irons are conventionally balanced to produce a matched set.

The club lengths are progressively shorter as the number of the iron increases. To maintain the swing weight constant, that is, the effective weight felt by the golfer, the weights of the club heads progressively increase with increasing number. FIG. 3 illustrates how the clubs are swing weighted. The iron 10 is balanced on a fulcrum F at a distance A from the free end. A weight W is hung from the free end. The length of the iron 10 is represented by the sum of the lengths A and B. The weight of the head 13 and the combined length of the club A+B determines the weight W needed to balance the iron 10. For every other iron in the set, when the fulcrum is placed at the distance A from its end, the same weight W will be needed to balance it, despite the fact that the length B is progressively shorter for increasingly numbered irons. The result is a constant feel to the golfer from the standpoint of swing weight.

However, even with the swing weights balanced, the differing twist or torque of current "matched sets", as will be explained below, makes the "feel" differ from club to club.

As shown in FIG. 2, the plane of the hitting surface 15 forms an angle 19 with the vertical. For example, the loft angle 19 is about 20° for a number 2 iron, and about 47° for a number 9 iron.

In FIGS. 1 and 2 the iron 10 is shown at the moment of impact, that is, the instant when the surface 15 strikes a golf ball 20. At that instant, the plane of the surface 15 is perpendicular to a plane containing the line of proposed flight of the ball 20. If that relationship is maintained during the interval that the surface 15 is in contact with the ball 20, no right or left-hand spin would be imparted to the ball 20. However, any slight variation in the orientation of the surface 15 will impart side spin in one direction or the other, causing the ball to hook or slice depending upon the direction of the spin.

It is no simple task to maintain the surface 15 "square" to the proposed line of flight and most golfers experience at least some difficulty with respect to hooking and/or slicing of the ball.

This difficulty arises at least in part because of the manner in which a golf club is swung and the golfer's anatomy. Initially the club is inclined downwardly so that the head is in back of the ball. The club is then swung rearwardly to a position such that the grip is held over the right shoulder (for a right-handed golfer). The club is swung in a large arc, striking the ball and terminating at a point where the grip is above the left shoulder. The orientation of the surface 15 changes markedly during the swing, although only slightly during the interval that the head is in contact with the ball. Any change, however, will impart spin to the ball. The changing orientation of the surface occurs because the golfer's hands are turning or twisting at the same time they are swinging. Because the head protrudes laterally from the shaft, a moment or twisting action about the axis of the shaft 11 is created. The amount of torque caused by the protruding head 13 is maximum with the shaft in a horizontal position, and minimum with the shaft disposed vertically. The magnitude of the twisting effect experienced by the golfer is between these positions, that is, at a position where the club is at the same inclination as when it is in its ball-addressing position. As explained above, this angle 18 in the case of a number 2 iron is 57°.

This twisting effect is troublesome because it differs from club to club. Thus, when the golfer swings a 2 iron, there is a given tendency to twist at its 57° angle of normal use, but a different tendency with a 9 iron at its corresponding angle of 64°.

Figure 4:
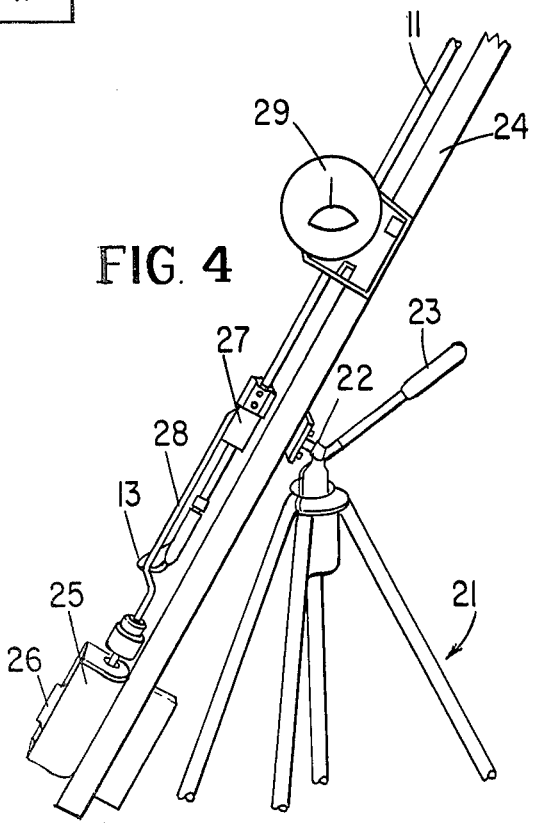
FIG. 4 is a fragmentary portion of an elevational view of apparatus to measure the torque of each iron about its shaft, an iron being shown in position to be measured.
Figure 4A:
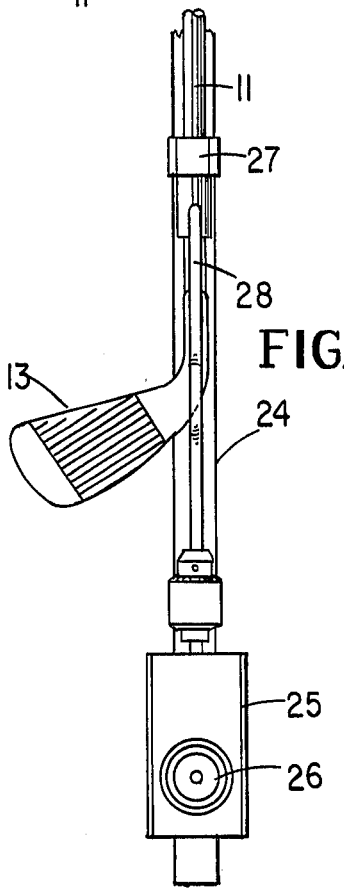
FIG. 4A is a plan view of the apparatus projected into a plane parallel to the plane of the bar in the apparatus of FIG. 4.

Illustrated in FIGS. 4 and 4A is an apparatus used to measure torque or twisting of the irons when held at their normal angles 18 at which they are positioned when the ball is being addressed.

The apparatus includes a tripod 21 carrying a universal joint 22 which is operated by a handle 23. A bar 24 is attached to the universal joint 22, whereby such bar can be oriented in any desired position. A torque meter 25 is mounted on one end of the bar 24. The meter 25 has a dial 26 on which torque can be read. The apparatus further includes a clamp 27 connected by means of a link 28 to the torque meter. The inclination of the bar 24, that is, the angle 18 it forms with the horizontal, is determined by the reading on a compass 29.

To measure the torque of an iron, its shaft is held by the clamp 27. The torque meter 25 is carefully "zeroed" so that its reading is zero when the iron is not clamped. The joint 22 is loosened and the bar 24 rotated to form a selected angle 18 with the horizontal. For example, if a number 2 iron is being measured, the bar 24 is positioned such that the reading on the compass 29 is 57°. The magnitude of torque exerted by the head about the axis of the iron appears on the meter 26.

The following torques (in inch pounds) were measured on three different sets of currently available irons:

| Iron No. | Angle 18 | Set I | Set II | Set III |
|---|---|---|---|---|
| 2 | 57° | — | .45 | .475 |
| 3 | 58° | .42 | .455 | .435 |
| 4 | 59° | .435 | .445 | .48 |
| 5 | 60° | .44 | .43 | .41 |
| 6 | 61° | .425 | .45 | .45 |
| 7 | 62° | .44 | .465 | .465 |
| 8 | 63° | .46 | .465 | .445 |
| 9 | 64° | .405 | .495 | .42 |

Set I was manufactured by Wilson Sporting Goods under its model no. 1200 LT. Set II was manufactured by Lynx Precision Golf Equipment under its model no. USA. Set III was manufactured by Square Two Golf Clubs under its model no. Square Two.

The average player finds it difficult to compensate for differences in feel from club to club, and, therefore, will hook shots made with some clubs and slice shots made with other clubs.

Figure 5:
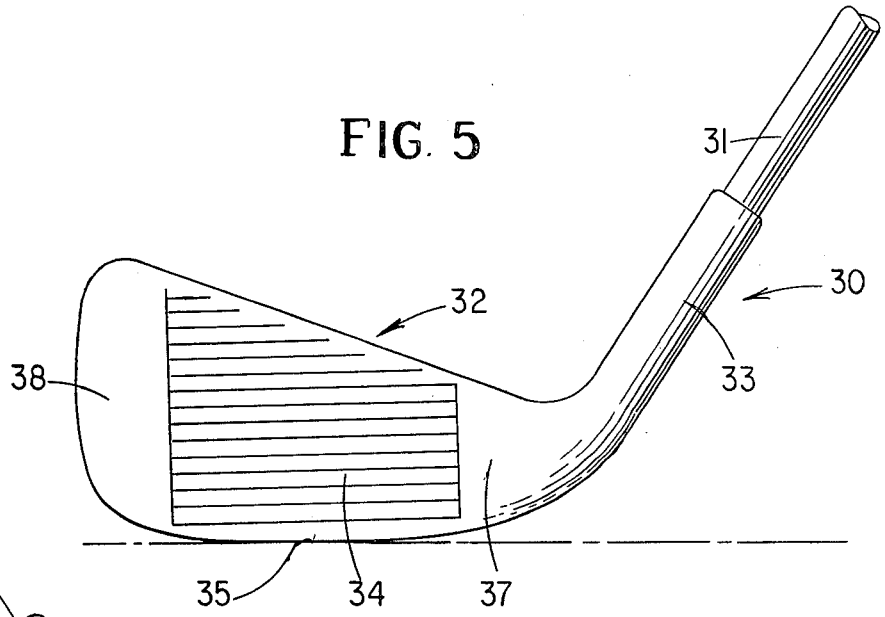
FIG. 5 is a fragmentary view of the head of a number 2 iron incorporating the features of the present invention.
Figure 6:
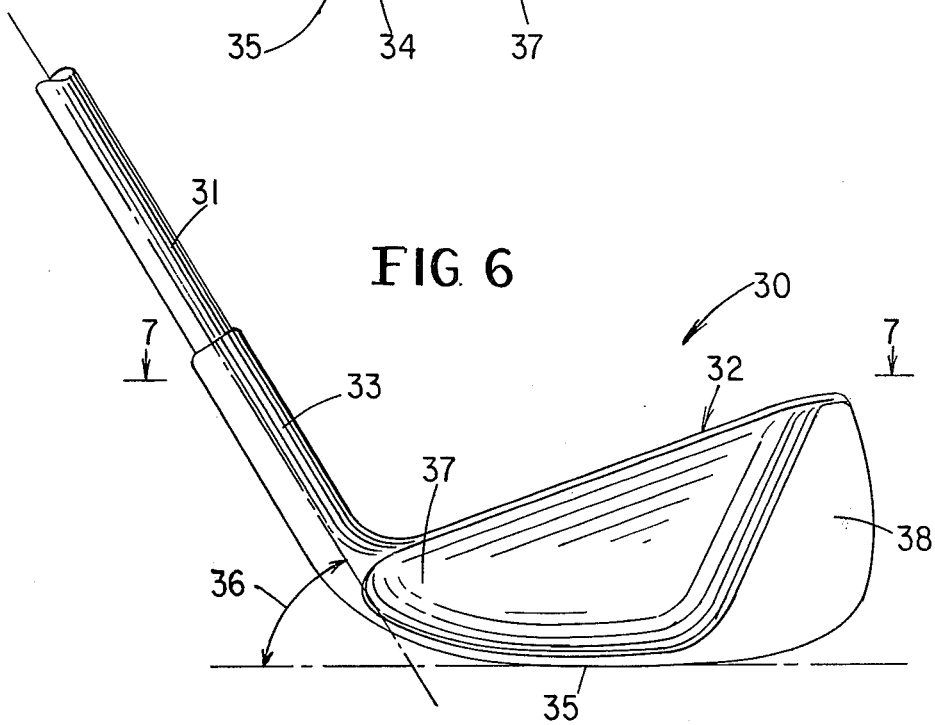
FIG. 6 is a rear view of the head of the iron depicted in FIG. 5.
Figure 7:
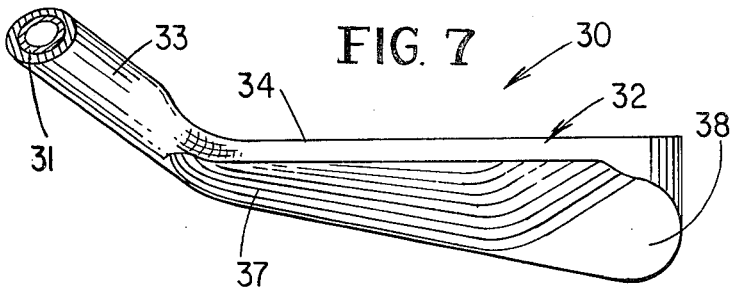
FIG. 7 is a top view of the head of FIG. 6 projected into a plane perpendicular to the plane of the hitting surface.

The present invention proposes to eliminate this change in feel resulting from the change in twist or torque about the shaft axis from club to club. FIGS. 5, 6 and 7 illustrate the head of one iron of the set so designed. There is shown an iron 30 having a shaft 31 and a head 32. The head 32 has a hosel 33 within which the shaft 31 is inserted and permanently secured. The head 32 has a hitting surface 34 and a sole 35 which rests on the ground as previously explained. The angle 36 is 57° since the club shown is a 2 iron. Referring to FIG. 6, the weight in the club head 32 has been redistributed by removing material from the heel 37, that is, the region near the hosel 33, and adding material to the toe 38, that is, the portion farthest from the hosel 33. Such redistribution of weight of the head 32 increases the moment about the shaft 31. The weight redistribution in FIG. 6 is selected to increase the turning moment to correspond to the turning moment of the 9 iron which happens to be the iron most people hit the best.

Figure 8:
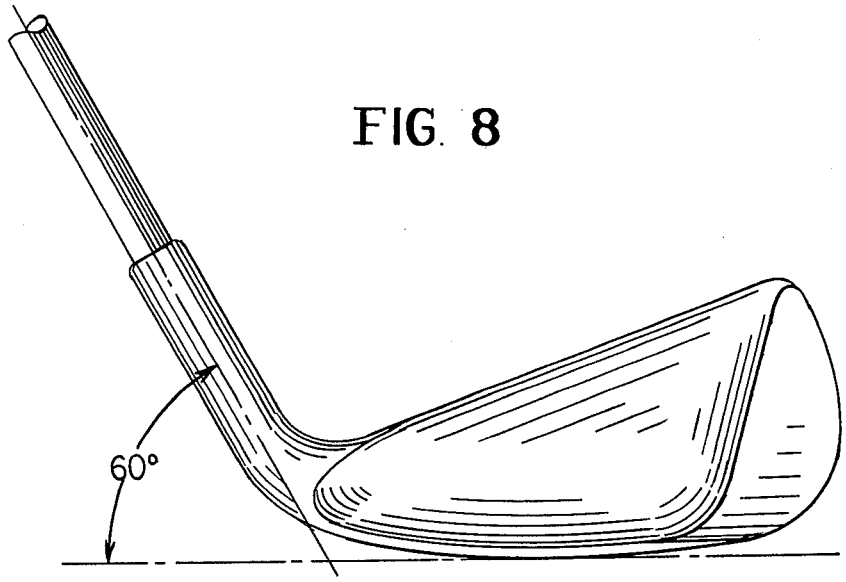
FIG. 8 is a view like FIG. 6, but of a 5 iron.
Figure 9:
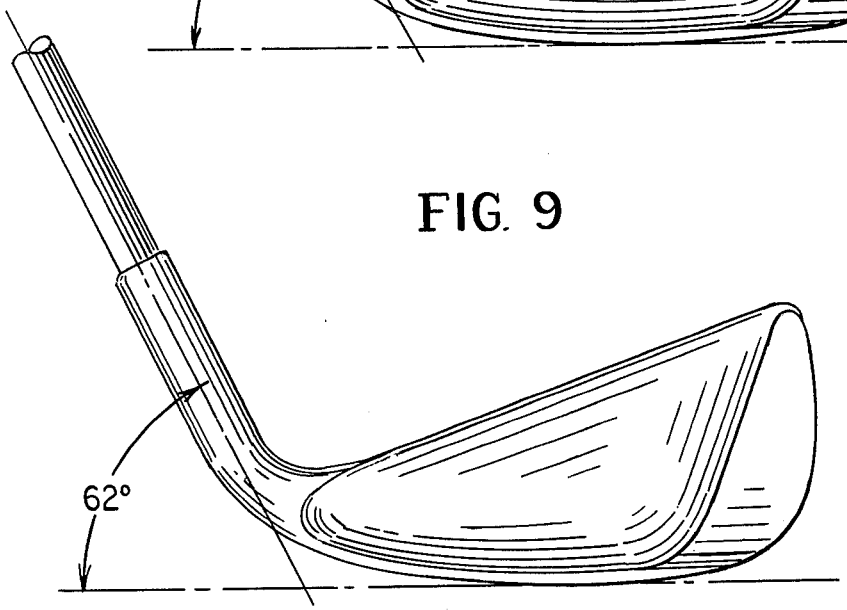
FIG. 9 is a view like FIG. 6, but of a 7 iron.
Figure 10:
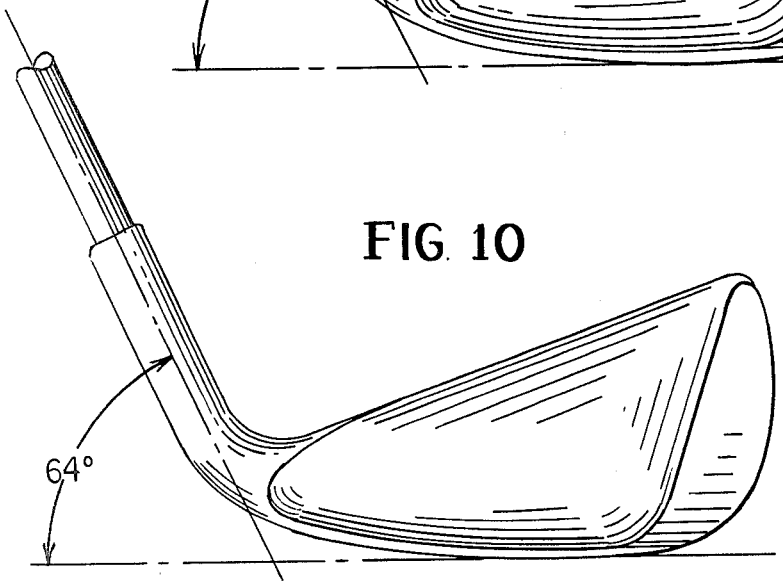
FIG. 10 is a view like FIG. 6, but of a 9 iron.

FIG. 8 illustrates the head of the number 5 iron in which somewhat less weight has been added to the toe. FIG. 9 illustrates the configuration of the head for the number 7 iron in which even less weight has been added to the toe portion. FIG. 10 illustrates the number 9 iron in which the appearance has been modified with no change in weight distribution made.

The weight distribution of the 2, 5, 7 and 9 irons illustrated in FIGS. 5–10 are selected to provide a constant turning moment about the shaft axis when at the associated use angles of these irons. For example, if a golfer is pleased with a 9 iron having a 7.0 inch ounce torque at its use angle of 64°, then the weight on the head of his number 5 iron will be readjusted as shown in FIG. 8 such that the torque about its axis when measured at its use angle of 60° is also 7.0 inch ounces. Similarly, the weight in the head of the number 7 iron, shown in FIG. 9, would be redistributed so that its torque would be 7.0 inch ounces about its shaft when measured at its use angle of 62°. Although the other irons are not shown, it is to be understood that a redistribution of weight in each head would be made such that the torque about each shaft axis when measured at its associated use angle is 7.0 inch ounces.

This analysis is made on the supposition that the particular golfer hits and likes to use best his number 9 iron. However, the invention is equally applicable to balancing the torque to other irons. Suppose, for example, the golfer hits his 2 iron best. In that case, the weight in the heads of his irons numbered 3–9 would each be redistributed to match the torque of each at their associated use angles to the torque of the 2 iron at its use angle of 57°.

While the foregoing comments were made in respect to the irons numbered 2 through 9, it is to be understood that the same comments would be applicable to the number 1 iron or any of the special irons such as the pitching or sand wedges or the woods. In each case, the weight in the head of each club would be redistributed to match its torque with the torque of a given club.

Although FIGS. 5–10 illustrate a specific way in which the weight can be redistributed, it is to be understood that this is merely exemplary. Any configuration which achieves the result of the desired weight distribution will suffice.

I claim:

1. A set of at least four torque-balanced golfing clubs, each comprising a shaft and a head at one end thereof, the shafts of said clubs having different lengths, and the heads having different weights and different loft angles, the head of each club being adapted to rest on the ground such that a predetermined different angle is formed between the associated shaft and the ground, the weight distribution of each of said heads being such that the torque of each club about its shaft axis with the club oriented at its associated predetermined angle being substantially the same as the corresponding torque of every other club in said set of clubs.

2. The set of torque-balanced golfing clubs of claim 1, wherein each of said clubs is an iron.

* * * * *